US007423595B2

(12) United States Patent
Säily

(10) Patent No.: US 7,423,595 B2
(45) Date of Patent: Sep. 9, 2008

(54) DUAL-POLARIZED MICROSTRIP STRUCTURE

(75) Inventor: Jussi Säily, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/600,142

(22) Filed: Nov. 16, 2006

(65) Prior Publication Data

US 2007/0126641 A1 Jun. 7, 2007

(30) Foreign Application Priority Data

Dec. 2, 2005 (FI) ..... 20055637

(51) Int. Cl.
*H01Q 1/38* (2006.01)

(52) U.S. Cl. ..... 343/700 MS; 343/846

(58) Field of Classification Search ..... 343/700 MS, 343/767, 770, 846; 455/562.1
See application file for complete search history.

(56) References Cited

U.S. PATENT DOCUMENTS 5,355,143 A * 10/1994 Zurcher et al. ..... 343/700 MS
5,534,877 A * 7/1996 Sorbello et al. ..... 343/700 MS
6,018,320 A * 1/2000 Jidhage et al. ..... 343/700 MS
6,107,965 A * 8/2000 Christ ..... 343/700 MS
6,864,840 B2 * 3/2005 Zhu et al. ..... 343/700 MS
7,091,907 B2 * 8/2006 Brachat ..... 343/700 MS
2007/0126638 A1 * 6/2007 Channabasappa .... 343/700 MS
2007/0296635 A1 * 12/2007 Popugaev et al. ..... 343/700 MS
2008/0001837 A1 * 1/2008 Liu ..... 343/767

* cited by examiner

*Primary Examiner*—Tan Ho
(74) *Attorney, Agent, or Firm*—Squire, Sanders & Dempsey L.L.P.

(57) ABSTRACT

A dual-polarized microstrip patch antenna structure comprising: a dual microstrip feed line circuitry underneath a bottom dielectric substrate; a ground plane layer overlying the bottom dielectric substrate, the ground plane layer having coupling apertures etched to the ground plane layer; a middle metallized patch layer stacked over a middle dielectric substrate; a top metallized patch layer stacked underneath a top dielectric substrate; and an air layer between the middle dielectric substrate and the top dielectric substrate separating the middle metallized patch layer and the top metallized patch layer. The microstrip feed line circuitry is configured to utilize corner-feeding techniques for enabling diagonal modes of the patch layers, and the coupling apertures of the ground plane layer are provided with a non-resonant bow-tie shape for enabling aperture coupling between the microstrip feed line circuitry and the patch layers.

29 Claims, 6 Drawing Sheets

DUAL-POLARIZED MICROSTRIP STRUCTURE

FIELD

The invention relates to a dual-polarized microstrip patch antenna structure and to a method of making thereof.

BACKGROUND

Modern base station antennas use diversity techniques to reduce the effects of multipath fading. The most common diversity techniques are space and polarization diversities. Space diversity requires that the receiving antennas be placed far from each other so that independent samples of the incoming field are obtained. Hand-held phones transmit at both horizontal and vertical linear polarizations due to tilting of their antennas. The horizontal and vertical polarizations are uncorrelated. Polarization diversity is most commonly achieved by using dual-polarized (typically ±45° slanted polarizations) antennae at the base station. Nowadays, antennas using polarization diversity are preferred due to ease of installation and lower costs over space diversity antennas.

The base station antenna array consists of many antenna elements. The antenna elements should be easily manufacturable and should require minimum tuning during production. Further, the cost of used substrate materials of the antenna elements should be minimized. The RF (Radio Frequency) performance requirements are also very tight: a return loss better than 14 dB (Voltage Standing Wave Ratio, VSWR, <1.5) and a polarization isolation better than 30 dB are required.

Dual-polarized or dual-polarized aperture coupled, patch antennas are often used. Dipole antennas are broadband and many different dual-polarized dipole configurations have been developed. However, most dual-polarized dipole antenna configurations are mechanically complex due to the required feeding baluns for dipole branches. This results in high assembly costs due to manual labor, although the sheet material costs are low. Further, the dipole radiation patterns are typically very broad and shaped reflector ground planes are required for generating the desired beam patterns and for reducing back lobes.

Recently planar aperture-coupled patch antennas have also been developed. In this technique, a specially shaped aperture is etched into a ground plane between a microstrip feed line and a radiating patch. The dual feed lines required for dual polarizations can be arranged in different ways. Offset aperture slots are most commonly used and they can be coupled to either the patch diagonal or basic patch modes. A cross-shaped aperture can also give a good port isolation but the feed lines must be either on different layers or use non-symmetric arrangements. Deviation from symmetry usually then means increased cross-polarization and reduced port isolation.

Most recent dual-polarized patch antenna types are the L-probe fed microstrip patch antennas of Chinese origin. In the L-probe feeding technique, an L-shaped wire is located under the microstrip patch and it is used to proximity-couple the signal to the patch. However, the L-probe coupled antennas are mechanically more complex than aperture-coupled antennas due to the required air gaps and supports. The problem with dual-polarized L-probe fed antennas is the low polarization isolation resulting from a direct coupling between the vertical parts of the feed probes. New solutions for overcoming the aforementioned problems are needed.

BRIEF DESCRIPTION OF THE INVENTION

An object of the invention is to provide an improved dual-polarized microstrip patch antenna structure and an improved method of making a dual-polarized microstrip patch antenna structure.

According to an aspect of the invention, there is provided a dual-polarized microstrip patch antenna structure comprising: a dual microstrip feed line circuitry underneath a bottom dielectric substrate; a ground plane layer overlying the bottom dielectric substrate, the ground plane layer having coupling apertures etched to the ground plane layer; a middle dielectric substrate overlying the bottom dielectric substrate and the ground plane layer; a middle metallized patch layer stacked over the middle dielectric substrate; a top dielectric substrate over the middle dielectric substrate and the middle metallized patch layer; a top metallized patch layer stacked underneath the top dielectric substrate and above the middle metallized patch layer for generating two polarized beams with the middle metallized patch layer; and an air layer between the middle dielectric substrate and the top dielectric substrate separating the middle metallized patch layer and the top metallized patch layer. The microstrip feed line circuitry is configured to utilize corner-feeding techniques for enabling diagonal modes of the patch layers, and the coupling apertures of the ground plane layer are provided with a non-resonant bow-tie shape for enabling aperture coupling between the microstrip feed line circuitry and the patch layers.

According to another aspect of the invention, there is provided an method of making a dual-polarized microstrip patch antenna structure, the method comprising: assembling a dual microstrip feed line circuitry underneath a bottom dielectric substrate, the microstrip feed line circuitry being configured to utilize corner-feeding techniques for enabling diagonal modes of the patch layers; providing a ground plane layer over the bottom dielectric substrate, the ground plane layer having coupling apertures etched to the ground plane layer; providing a middle dielectric substrate over the bottom dielectric substrate and the ground plane layer; assembling a middle metallized patch layer over the middle dielectric substrate; providing a top dielectric substrate over the middle dielectric substrate and the middle metallized patch layer; assembling a top metallized patch layer underneath the top dielectric substrate and above the middle metallized patch layer for generating two polarized beams with the middle metallized patch layer; providing an air layer between the middle dielectric substrate and the top dielectric substrate separating the middle metallized patch layer and the top metallized patch layer; and providing the coupling aperture of the ground plane layer with a non-resonant bow-tie shape for enabling aperture coupling between the microstrip feed line circuitry and the patch layers.

The method and system of the invention provide several advantages. The input matching is improved. The antenna structure requires minimal tuning in production. Manufacturing is thus easy and cost-effective. Due to the simple structure, a very good tolerance of manufacturing errors is achieved. Very low profile constructions without any losses in performance are enabled. High front-to-back ratios can be obtained and maximum coupling between feed line and patch layer is enabled at the same time.

LIST OF DRAWINGS

In the following, the invention will be described in greater detail with reference to the preferred embodiments and the accompanying drawings, in which FIG. 1 is a simplified block diagram illustrating the structure of a radio system;

DESCRIPTION OF EMBODIMENTS

Figure 1:
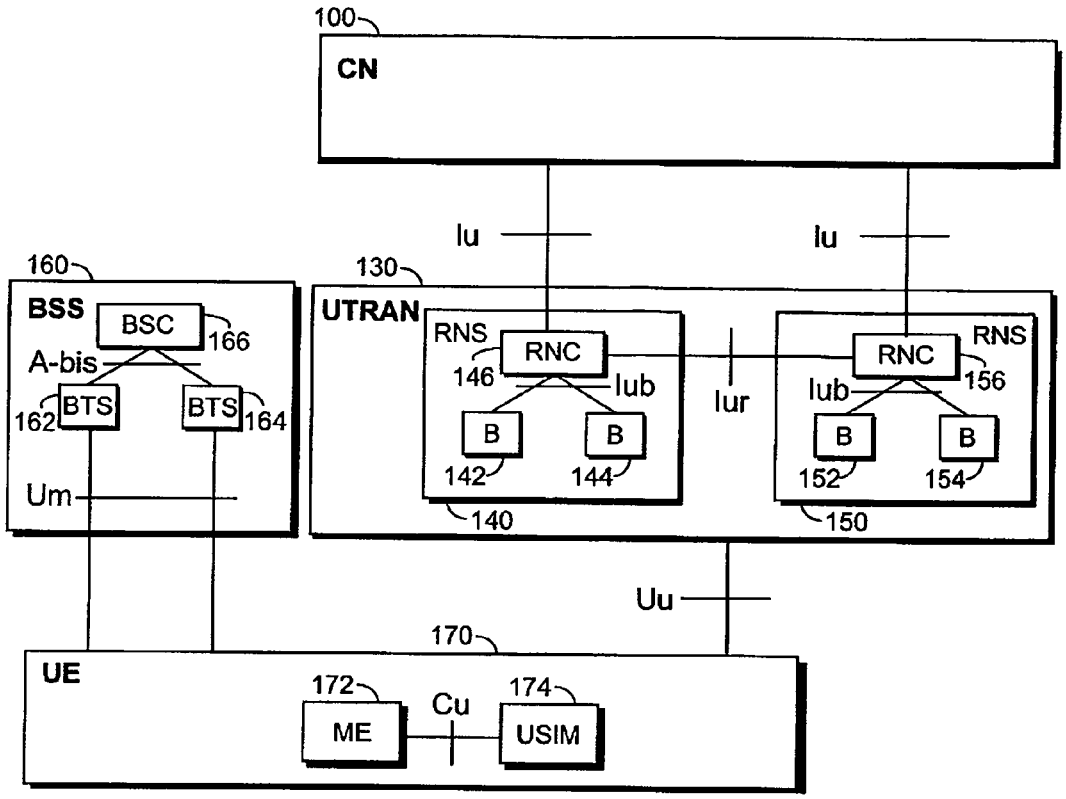

With reference to FIG. 1, examine an example of a radio system in which the preferred embodiments of the invention can be applied. A radio system in FIG. 1, known at least as UMTS (Universal Mobile Telecommunications System) and IMT-2000 (International Mobile Telecommunications 2000), represents the third-generation radio systems. The embodiments are, however, not restricted to these systems described by way of example, but a person skilled in the art can also apply the instructions to other radio systems containing corresponding characteristics.

FIG. 1 is a simplified block diagram, which shows the most important parts of a radio system and the interfaces between them at network-element level. The structure and functions of the network elements are not de-scribed in detail, because they are generally known.

The main parts of a radio system are a core network (CN) 100, a radio access network 130 and user equipment (UE) 170. The term UTRAN is short for UMTS Terrestrial Radio Access Network, i.e. the radio access net-work 130 belongs to the third generation and is implemented by wideband code division multiple access (WCDMA) technology. FIG. 1 also shows a base station system 160 which belongs to the 2/2.5 generation and is implemented by time division multiple access (TDMA) technology, but it is not further described here.

On a general level, the radio system can also be defined to comprise user equipment, which is also known as a subscriber terminal and mobile phone, for instance, and a network part, which comprises the fixed infrastructure of the radio system, i.e. the core network, radio access network and base station system.

The structure of the core network 100 corresponds to a combined structure of the GSM and GPRS systems. The GSM network elements are responsible for establishing circuit-switched connections, and the GPRS network elements are responsible for establishing packet-switched connections; some of the network elements are, however, in both systems.

The base station system 160 comprises a base station controller (BSC) 166 and base transceiver stations (BTS) 162, 164. The base station controller 166 controls the base transceiver station 162, 164. In principle, the aim is that the devices implementing the radio path and their functions reside in the base transceiver station 162, 164, and control devices reside in the base station controller 166.

The base station controller 166 takes care of the following tasks, for instance: radio resource management of the base transceiver station 162, 164, intercell handovers, frequency control, i.e. frequency allocation to the base transceiver stations 162, 164, management of frequency hopping sequences, time delay measurement on the uplink, implementation of the operation and maintenance interface, and power control.

The base transceiver station 162, 164 contains at least one transceiver, which provides one carrier, i.e. eight time slots, i.e. eight physical channels. Typically, one base transceiver station 162, 164 serves one cell, but it is also possible to have a solution in which one base transceiver station 162, 164 serves several sectored cells. The diameter of a cell can vary from a few meters to tens of kilometers. The base transceiver station 162, 164 also comprises a transcoder, which converts the speech-coding format used in the radio system to that used in the public switched telephone network and vice versa. In practice, the transcoder is, however, physically located in the mobile services switching center. The tasks of the base transceiver station 162, 164 include: calculation of timing advance (TA), uplink measurements, channel coding, encryption, decryption, and frequency hopping.

The radio access network 130 is made up of radio network subsystems 140, 150. Each radio network subsystem 140, 150 is made up of radio network controllers 146, 156 and B nodes 142, 144, 152, 154. A B node is a rather abstract concept, and often the term base transceiver station is used instead of it.

Operationally, the radio network controller 140, 150 corresponds approximately to the base station controller 166 of the GSM system, and the B node 142, 144, 152, 154 corresponds approximately to the base transceiver station 162, 164 of the GSM system. Solutions also exist in which the same device is both the base transceiver station and the B node, i.e. said device is capable of implementing both the TDMA and WCDMA radio interface simultaneously.

The user equipment 170 may comprise mobile equipment (ME) 172 and a UMTS subscriber identity module (USIM) 174. USIM 174 contains information related to the user and information related to information security in particular, for instance, an encryption algorithm.

In UMTS networks, the user equipment 170 can be simultaneously connected with a plurality of base transceiver stations (Node B) in occurrence of soft handover.

In UMTS, the most important interfaces between network elements are the lu interface between the core network and the radio access network, which is divided into the interface luCS on the circuit-switched side and the interface luPS on the packet-switched side, and the Uu interface between the radio access network and the user equipment. In GSM, the most important interfaces are the A interface between the base station controller and the mo-bile services switching center, the Gb interface between the base station controller and the serving GPRS support node, and the Um interface between the base transceiver station and the user equipment. The interface defines what kind of messages different network elements can use in communicating with each other. The aim is to provide a radio system in which the network elements of different manufacturers interwork well so as to provide an effective radio system. In practice, some of the interfaces are, however, vendor-dependent.

Figure 2:
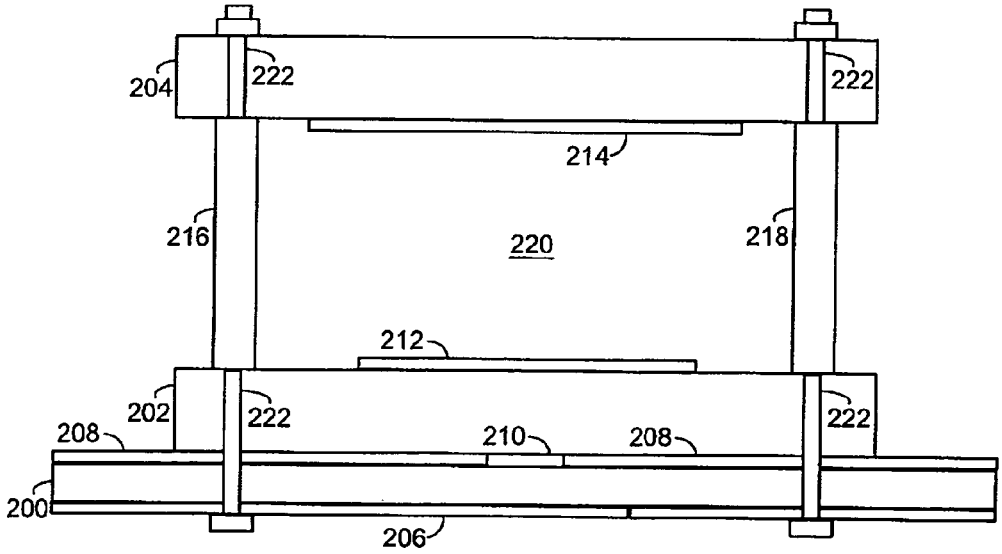
FIG. 2 shows an example of a dual-polarized microstrip patch antenna structure.

FIG. 2 shows an example of a dual-polarized microstrip patch antenna structure according to an embodiment. The antenna structure comprises three different radio frequency dielectric substrate layers 200, 202, 204 stacked together as can be seen in FIG. 2. The bottom dielectric substrate 200 has two metallization layers that comprise a dual microstrip feed line circuitry 206 underneath the bottom dielectric substrate 200, and its associated ground plane layer 208 overlying the bottom dielectric substrate 200. The ground plane layer 208 further has coupling apertures 210 with optimised location and a modified bow-tie shape etched to the ground plane layer 208.

The substrate material of the bottom dielectric substrate 200 is, for example, 0.762-mm-thick Rogers RO4350B or Taconic RF-35A having dielectric constants of 3.48 and 3.5, respectively. If a thicker material is used, the coupling aperture should be larger for the same coupling efficiency. This, however, may result in a decreased front-to-back ratio. The thickness range of the bottom dielectric substrate 200 is from 0.5 mm to 1.0 mm. The dielectric constant of the bottom dielectric substrate can vary from 3 to 4. The thickness of the feed line circuitry 206 and the ground plane layer 208 is 18-35 μm.

A middle dielectric substrate 202 overlies the bottom dielectric substrate 200 and the ground plane layer 208. The middle dielectric substrate 202 has only one metallization layer, a middle metallized patch layer 212 being stacked over the middle dielectric substrate 202. The middle metallized patch layer 212 is processed on the upper surface of the middle dielectric substrate 202, which is then mounted directly on top of the bottom dielectric substrate 200 with no air gap. This ensures maximum coupling and eases assembly.

The substrate material of the middle dielectric substrate 202 is, for example, 1.57-mm-thick Rogers RO5870 (PTFE microfiber composite from Rogers Corp.) Duroid material with a dielectric constant of 2.33. PTFE stands for polytetrafluoroethylene, and Duroid is a trademark of Rogers Corp. (a teflon-based microwave substrate). The thickness range of the middle dielectric substrate 202 is from 1 to 2, and the dielectric constant is 2-2.5. The thickness of the middle metallized patch layer 212 can again be 18-35 μm. Using cheaper materials, such as Taconic TLY-3 with a dielectric constant of 2.33, is also possible but the material anisotropy can be unsatisfactory due to its woven fibreglass content. Rogers RO5870 has a microfiber filling that is close to isotropic at the required frequency range.

A top dielectric substrate 204 is placed over the middle dielectric substrate 202 and the middle metallized patch layer 212. The top dielectric substrate 204 has also one metallization layer where the patch is processed. A top metallized patch layer 214 is stacked underneath the top dielectric substrate 204 and above the middle metallized patch layer 212 for generating two polarized beams with the middle metallized patch layer 212. It is also possible to arrange the top metallized patch layer 212 on top of the top dielectric substrate 204.

The substrate material of the top dielectric substrate 204 is, for example, Taconic TLY-5A with a dielectric constant of 2.17 and a thickness of 1.57 mm. The range of thickness of the top dielectric substrate 204 is from 1 to 2, and the dielectric constant can be 2-2.5. The thickness of the top metallized patch layer 214 is, for example, 18-35 μm.

The antenna structure further comprises an air layer 220 between the middle dielectric substrate 202 and the top dielectric substrate 204 separating the middle metallized patch layer 212 and the top metallized patch layer 214. The air layer 220 can include an air gap or a foam layer. In an embodiment, spacers 216, 218 of PVC (polyvinyl chloride) plastic, for example, can be used between the middle dielectric substrate 202 and the top dielectric substrate 204 for spacing them apart. The spacers 216, 218 can be, for example, 12-mm-long plastic spacers. Nylon screws 222 can be used to put the antenna structure together. The metallized patch layers 212, 214 can be made from solid brass or from other metals, the thickness of which being 0.5-1.5 mm, for example. When a solid metal patch is used, a foam spacer between the substrates is recommended. It is possible that a 1-cm-thick Rohacell foam base-plate is used in the antenna structure. The antenna structure is not limited to the materials described above but different materials including metal and plastic can be used. Further, the different dimensions and values given here can be modified somewhat depending on the used materials.

In an embodiment, the middle dielectric substrate 202 and the top dielectric substrate 204 are equal in thickness and the thickness of the bottom dielectric substrate 200 is less than or equal to half of the thickness of the middle or top dielectric substrate.

In an embodiment, the microstrip feed line circuitry 206 is configured to utilize corner-feeding techniques for enabling diagonal modes of the patch layers 212, 214, and the coupling apertures 210 of the ground plane layer 208 are provided with a non-resonant bow-tie shape for enabling maximum aperture coupling between the microstrip feed line circuitry 206 and the patch layers 212, 214.

Figure 3:
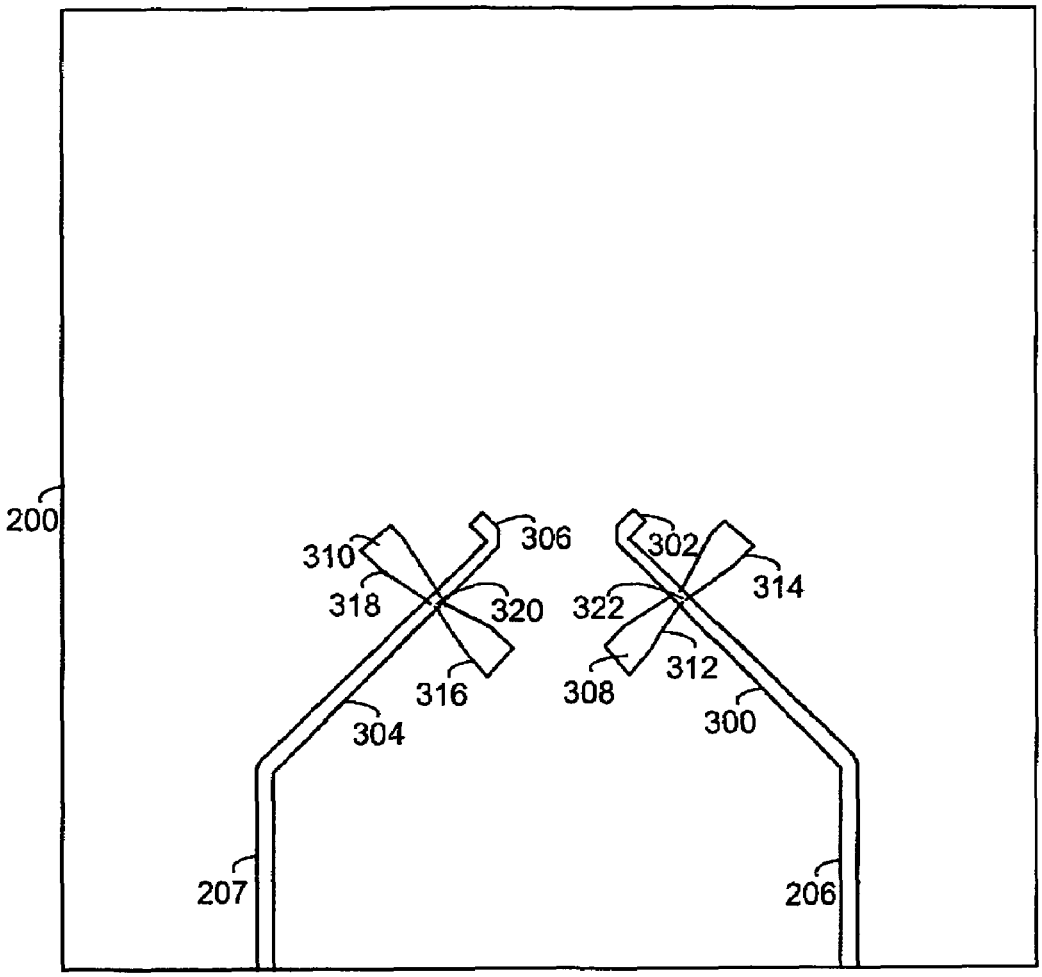
FIG. 3 shows an example of a layout view of the antenna structure from below.

FIG. 3 shows a simplified example of the antenna structure of FIG. 2 from below. A typical way for obtaining a dual-polarized aperture-coupled microstrip antenna is to provide two orthogonal apertures in the feed line ground plane 200. Each aperture then excites the patch layers in a single direction.

In an embodiment of FIG. 3, the feed line circuitry comprises horizontal feed lines 206, 207 that are positioned parallel to each other. Each feed line 206, 207 includes an open-ended matching stub 300, 304 that extends towards the center of the middle metallized patch layer. The matching stubs 300, 304 are spaced from each other. The matching stubs 300, 304 are bent forty-five degrees in relation to the first parts 206, 207 of the feed lines. Further, each matching stubs 300, 304 includes a tip 302, 306 bending ninety degrees in relation to the matching stub 300, 304 and extending outwards from the center of the antenna structure.

The two coupling apertures 308, 310 of the ground plane 200 are symmetrical. Each bow-tie shape of the coupling apertures 308, 310 of the ground plane 200 comprises a middle part 320, 322 and two end parts 312, 314, 316, 318. The coupling aperture 308, 310 continuously narrows towards the middle part 320, 322 with respect to the end parts 312, 314, 316, 318. The coupling apertures 308, 310 are in perpendicular alignment with respect to the respective matching stubs 300, 304, and the middle part 320, 322 of the coupling aperture 308, 310 and the respective matching stub 300, 304 are opposed. Thus, the middle metallized patch layer 212 of FIG. 2 is excited via the two bow-tie shaped apertures 308, 310.

Figure 4:
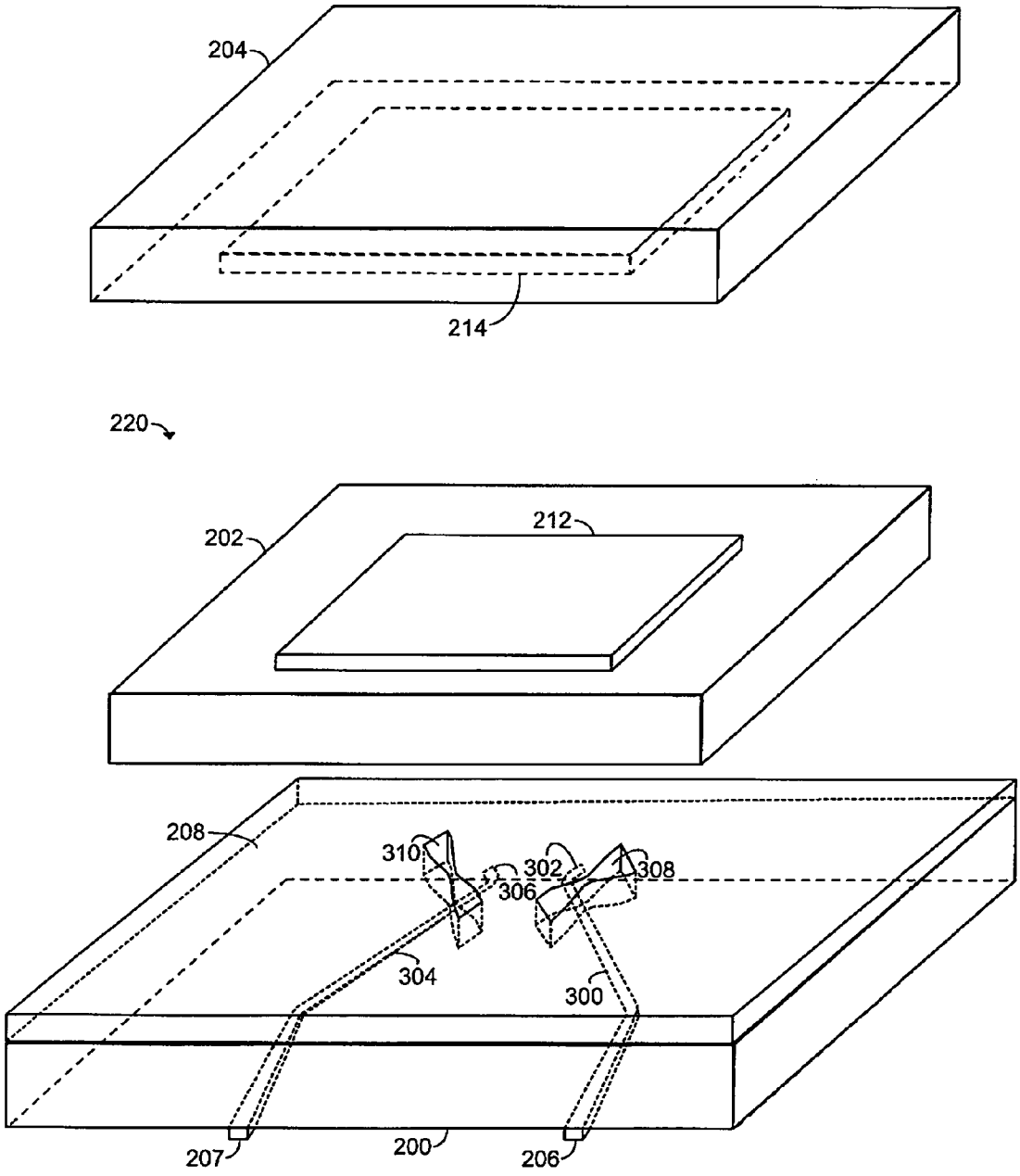
FIG. 4 shows a perspective view of the dual-polarized microstrip patch antenna structure.

FIG. 4 shows a simplified perspective view of the dual-polarized microstrip patch antenna structure. The dimensions of the exemplary antenna structure are not in proper scale. The example is merely for demonstrating the elemental structures of the antenna.

A dual microstrip feed line circuitry having two feed lines 206, 207 is underneath a bottom dielectric substrate 200. The both feed lines 206, 207 are positioned parallel to each other beginning from the same edge of the bottom dielectric substrate 200. The feed lines are symmetrically shaped in relation to one another. The end parts, i.e. matching stubs 300, 304, of the feed lines extend towards the center of the bottom dielectric substrate 200. The matching stubs 300, 304 are bent forty-five degrees in relation to first parts of the feed lines 206, 207. Each matching stub 300, 304 includes a tip 302, 306 bending ninety degrees in relation to the matching stub and extending towards the outer borders of the bottom dielectric substrate.

A ground plane layer 208 overlies the bottom dielectric substrate 200. The ground plane layer 208 has coupling apertures 308, 310 etched to the ground plane layer. The coupling apertures 308, 310 of the ground plane layer 208 are provided with a non-resonant bow-tie shape.

A middle dielectric substrate 202 overlies the bottom dielectric substrate 200 and the ground plane layer 208. A middle metallized patch layer 212 is stacked over the middle dielectric substrate 202. A top dielectric substrate 204 is over the middle dielectric substrate 202 and the middle metallized patch layer 212. A top metallized patch layer 214 is stacked underneath the top dielectric substrate 204 and above the middle metallized patch layer 212 for generating two polarized beams with the middle metallized patch layer.

Figure 6:
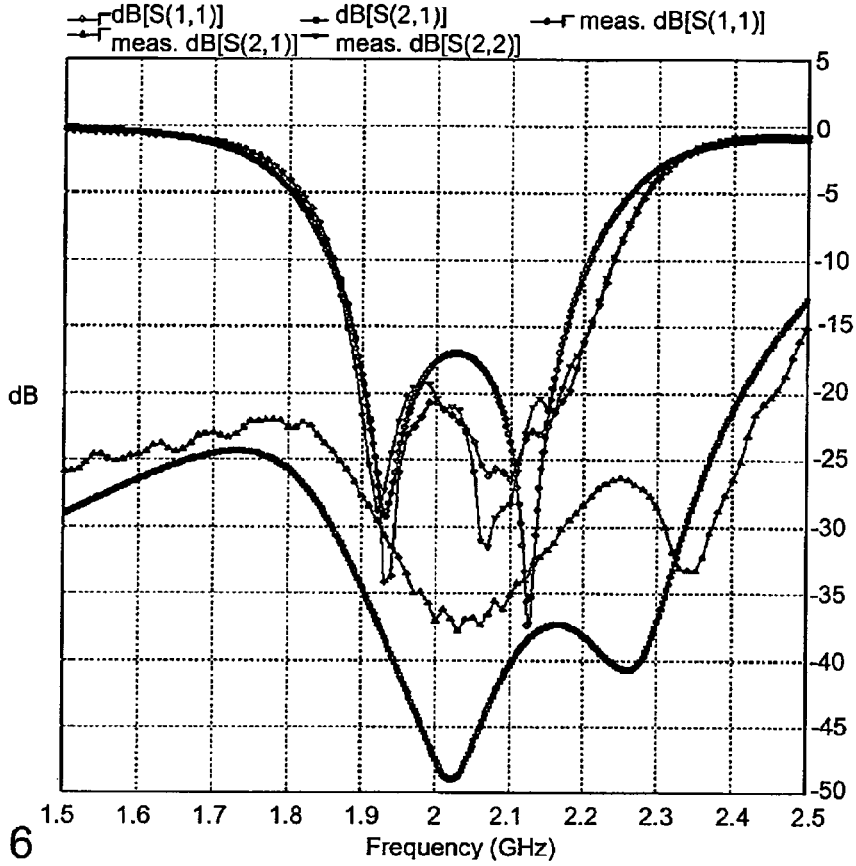
FIG. 6 shows example of measured input matchings of two polarization ports.

An air layer 220 is provided between the middle dielectric substrate 202 and the top dielectric substrate 204 for separating the middle metallized patch layer 212 and the top metallized patch layer 214. The spacing between the two metallized patch layers is optimised for bringing the patch resonances close together. An example of the measured input matchings of the two polarization ports is shown in FIG. 6. From FIG. 6, it can be seen that the input matchings are below −19 dB over the UMTS band of 1920-2170 MHz.

Figure 7:
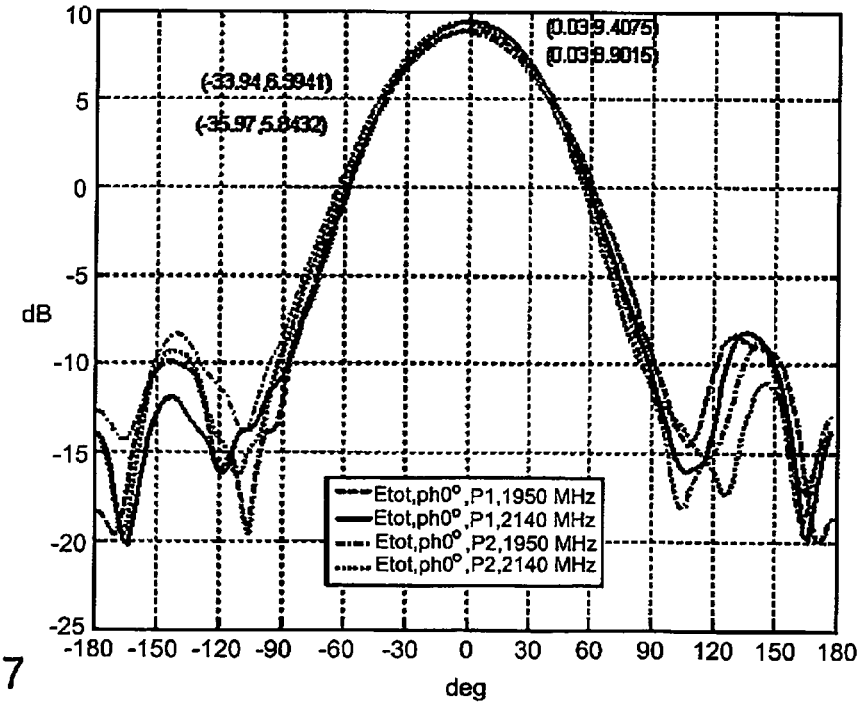
FIGS. 7 and 8 show examples of measured horizontal and vertical radiation patterns.
Figure 8:
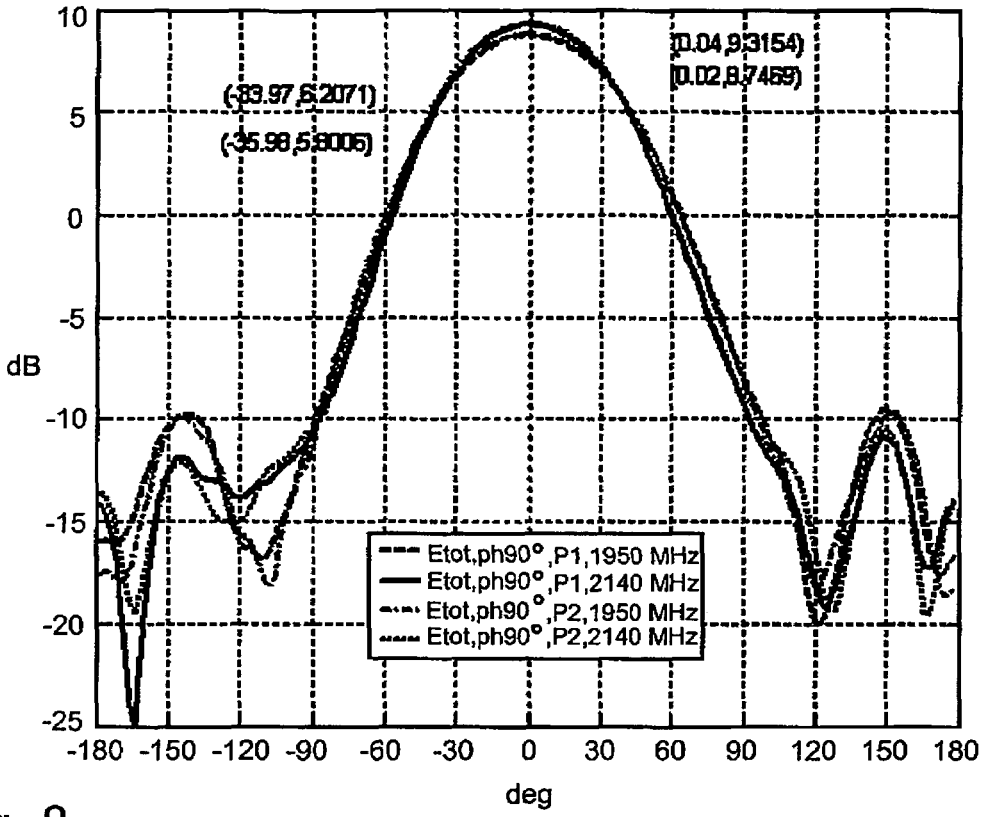

The microstrip feed line circuitry is configured to utilize corner-feeding techniques for enabling diagonal modes of the patch layers, and the coupling apertures with the non-resonant bow-tie shape enable maximum aperture coupling between the microstrip feed line circuitry and the patch layers. Examples of measured horizontal and vertical radiation patterns when using the proposed non-resonant aperture shapes are shown in FIGS. 7 and 8. As can be seen from FIGS. 7 and 8, using the proposed antenna structure enables a high front-to-back ratio greater than 22 dB. The aperture shapes and the substrate thickness are carefully optimised for enabling maximum coupling between the feed lines and the fed patch layers. The front-to-back ratio is maximised at the same time. Measured cross polarization levels in the diagonal planes are below −23 dB. The measured horizontal and vertical beam widths are 68 to 72°.

The surface area of the middle metallized patch layer 212 is, for example, 45×45 $mm^2$, and the size of the top metallized patch layer 214 can then be 51×51 $mm^2$. In order to warrant a high polarisation isolation, the middle dielectric substrate 202 should be somewhat larger than the patch layer 212 which is on it, for example 70×70 $mm^2$. The range of surface area of the middle metallized patch layer 212 is from 1849 to 2209 $mm^2$, the length of the sides of the patch layer 212 being 43-47 mm. The range of size of the top metallized patch layer 214 is from 2401 to 2809 $mm^2$, the length of the sides of the patch layer 214 being 49-53 mm. The range of surface area of the middle dielectric substrate 202 is from 3025 to 6400 $mm^2$, the length of the sides of the substrate 202 being 55-80 mm. The air layer 220 comprising air or foam is, for example, 12 mm high. The range of height of the air layer 220 is from 10 to 14 mm.

The used materials can be standard microwave and base station antenna materials having very low losses in the 2 GHz range. For example, the loss tangent for RO4350B is 0.0040 and 0.0012 for RT/Duroid 5870. For example, simulated antenna radiation efficiencies, including substrate losses, have been 96.7% at 1950 MHz and 96.8% at 2140 MHz when using an antenna structure of an embodiment. Feed network losses are, however, inevitable with all kinds of large antenna arrays, even with dipole elements. The antenna layout and materials are designed to be compatible with electromagnetic bandgap (EBG) ground planes. An EBG ground plane surrounding the antenna elements can be used to reduce mutual coupling between the elements.

The proposed aperture-coupled topology requires no extra substrate materials. For example, the full feed line network can be processed on the same RO4350B substrate with the antenna feed lines and coupling apertures. Small pieces of RT/Duroid 5870 providing the middle dielectric substrate 200 are required for each antenna element. The top metallized patch layer 214 can be made from solid 1-mm-thick brass. The back radiation of the elements is so low that no cavities behind the antennas are required. An advantage of the antenna structure is that the generated dual polarised beams and the port matching are perfectly symmetrical. The use of natural diagonal modes is also an advantage in slanted polarised arrays because the antenna patches are more easily located. The mutual coupling of diagonally polarised elements has also been observed to be lower with the same antenna spacing.

Figure 5:
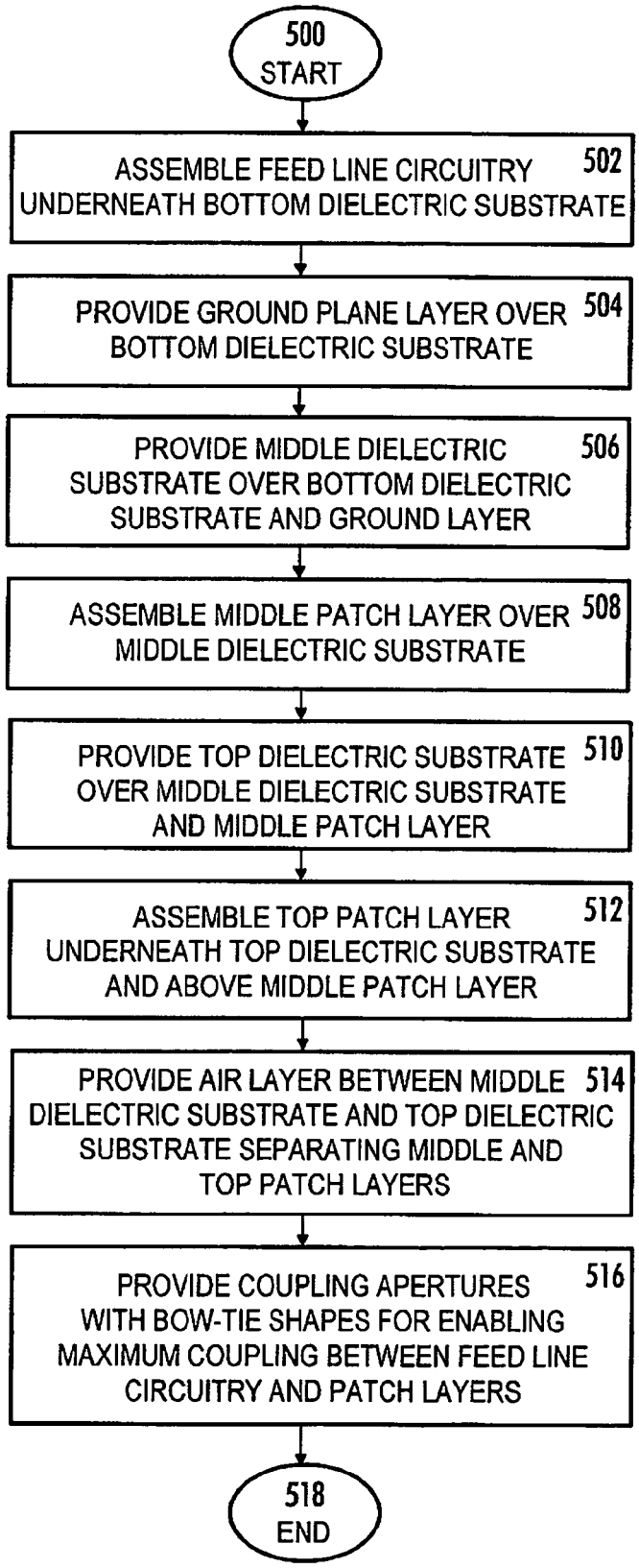
FIG. 5 illustrates an example of a method of making a dual-polarized microstrip patch antenna structure.

FIG. 5 illustrates an example of a method of making a dual-polarized microstrip patch antenna structure. The method steps described here can be performed in any possible order. The method starts in 500. In 502, a dual microstrip feed line circuitry is assembled underneath a bottom dielectric substrate, the microstrip feed line circuitry being configured to utilize corner-feeding techniques for enabling diagonal modes of the patch layers. In 504, a ground plane layer is provided over the bottom dielectric substrate, the ground plane layer having coupling apertures etched to the ground plane layer.

In 506, a middle dielectric substrate is provided over the bottom dielectric substrate and the ground plane layer. In 508, a middle metallized patch layer is assembled over the middle dielectric substrate. In 510, a top dielectric substrate is provided over the middle dielectric substrate and the middle metallized patch layer. In 512, a top metallized patch layer is assembled underneath the top dielectric substrate and above the middle metallized patch layer for generating two polarized beams with the middle metallized patch layer.

In 514, an air layer is provided between the middle dielectric substrate and the top dielectric substrate separating the middle metallized patch layer and the top metallized patch layer. In 516, the coupling aperture of the ground plane is provided with a non-resonant bow-tie shape for enabling aperture coupling between the microstrip feed line circuitry and the patch layers. The method ends in 518.

The antenna can be incorporated directly on the feed network printed circuit board (PCB). Thus, aperture-coupled patch antennas are very suitable for intelligent arrays with electrical beam control and tilt functions. All the required parts can be manufactured with a cost-effective PCB process with good tolerances. The antenna assembly can be automated as it only requires that suitable guiding pins stack the different PCBs. Microstrip patch antennas are less broadband than dipoles but the aperture-coupled variants can provide fractional bandwidths of more than 50% by utilizing several stacked patches. The back-lobe radiation is very low when non-resonant apertures are used. No special arrangements such as cavities behind the elements are required.

The proposed antenna structure is designed for easy manufacturing and requires minimal tuning in production as opposed to labor-intensive dipole antenna designs. Further, the proposed antenna structure has a low profile with a total height of 16 mm, for example. The total height of the antenna structure can be 12.5-19 mm. The low profile antenna structure is good for low mutual coupling base station arrays.

These are needed in intelligent antennas that can generate multiple beams and nulls toward users and interference. Further, the antenna structure can be provided with electromagnetic bandgap (EBG) ground planes for achieving extremely low mutual coupling phased array antennas. The substrate materials are carefully selected to be of high performance and cost-effective kinds. The only PTFE piece is the middle dielectric substrate that can be made from RO 5870. The input matching of the proposed antenna can be better than −19 dB over the full UMTS band (1920-2170 MHz), which increases tolerance to manufacturing. A common specification for base station antenna matching is VSWR Voltage Standing Wave Ratio)<1.5 or S11<−14 dB.

Even though the invention is described above with reference to an example according to the accompanying drawings, it is clear that the invention is not restricted thereto but it can be modified in several ways within the scope of the appended claims.

The invention claimed is:

1. An apparatus comprising:

a dual microstrip feed line circuitry underneath a bottom dielectric substrate;

a ground plane layer overlying the bottom dielectric substrate, the ground plane layer having coupling apertures etched to the ground plane layer;

a middle dielectric substrate overlying the bottom dielectric substrate and the ground plane layer;

a middle metallized patch layer stacked over the middle dielectric substrate;

a top dielectric substrate over the middle dielectric substrate and the middle metallized patch layer;

a top metallized patch layer stacked underneath the top dielectric substrate and above the middle metallized patch layer for generating two polarized beams with the middle metallized patch layer; and an air layer between the middle dielectric substrate and the top dielectric substrate separating the middle metallized patch layer and the top metallized patch layer, wherein the dual microstrip feed line circuitry is configured to utilize corner-feeding techniques to enable diagonal modes of the patch layers, and each of the coupling apertures of the ground plane layer are configured with a non-resonant bow-tie shape to enable aperture coupling between the microstrip feed line circuitry and the middle metallized patch layer and the top metallized patch layer.

2. The apparatus of claim 1, wherein feed lines of the dual microstrip feed line circuitry are positioned parallel to each other.

3. The apparatus of claim 1, wherein feed lines of the dual microstrip feed line circuitry each include a matching stub that extends towards the center of the middle metallized patch layer, wherein the matching stubs are spaced from each other.

4. The apparatus of claim 3, wherein each matching stub includes a tip bending ninety degrees in relation to the matching stub and extending outwards from a center of the bottom dielectric substrate.

5. The apparatus of claim 3, wherein each matching stub is bent forty-five degrees in relation to first parts of the feed lines.

6. The apparatus of claim 1, wherein the bow-tie shape of each of the coupling apertures of the ground plane comprises a middle part and two end parts, and wherein each of the coupling apertures are continuously narrowed towards the middle part with respect to the end parts.

7. The apparatus of claim 1, wherein the coupling apertures are in perpendicular alignment with respect to respective matching stubs.

8. The apparatus of claim 1, wherein a middle part of each of the coupling apertures and respective matching stubs are opposed.

9. The apparatus of claim 1, wherein the ground plane layer is provided with an electromagnetic bandgap ground plane for reducing mutual coupling between antenna elements.

10. The apparatus of claim 1, wherein the middle dielectric substrate and the top dielectric substrate are equal in thickness and a thickness of the bottom dielectric substrate is less than or equal to half of the thickness of the middle or top dielectric substrate.

11. The apparatus of claim 1, wherein the bottom dielectric substrate has a thickness of 0.5-1.0 mm and a dielectric constant of 3-4, the middle dielectric substrate has a thickness of 1-2 mm and a dielectric constant of 2-2.5, and the top dielectric substrate has a thickness of 1-2 mm and a dielectric constant of 2-2.5.

12. The apparatus of claim 1, wherein the dual microstrip feed line circuitry, the ground plane layer, the middle metallized patch layer and the top metallized patch layer each have a thickness of 18-35 μm.

13. The apparatus of claim 1, wherein a total height of the dual-polarized microstrip patch antenna structure is 12.5-19 mm.

14. The apparatus of claim 1, wherein the air layer comprises an air gap or a foam layer.

15. The apparatus of claim 1, wherein the air layer has a height of 10-14 mm.

16. The apparatus of claim 1, wherein a surface area of the middle metallized patch layer is 1849-2209 $mm^2$ and the surface area of the top metallized patch layer is 2401-2809 $mm^2$.

17. The apparatus of claim 16, wherein the surface area of the middle dielectric substrate is 3025-6400 $mm^2$.

18. The apparatus of claim 1, wherein a surface area of the middle dielectric substrate is larger than that of the middle metallized patch layer.

19. The apparatus of claim 1, wherein the middle metallized patch layer and/or the top metallized patch layer are 0.5-1.5-mm-thick brass or aluminum.

20. A method comprising:

assembling a dual microstrip feed line circuitry underneath a bottom dielectric substrate;

providing a ground plane layer over the bottom dielectric substrate, the ground plane layer having coupling apertures etched to the ground plane layer;

providing a middle dielectric substrate over the bottom dielectric substrate and the ground plane layer;

assembling a middle metallized patch layer over the middle dielectric substrate;

providing a top dielectric substrate over the middle dielectric substrate and the middle metallized patch layer;

assembling a top metallized patch layer underneath the top dielectric substrate and above the middle metallized patch layer for generating two polarized beams with the middle metallized patch layer;

providing an air layer between the middle dielectric substrate and the top dielectric substrate separating the middle metallized patch layer and the top metallized patch layer;

providing each of the coupling apertures of the ground plane layer with a non-resonant bow-tie shape to enable aperture coupling between the micro-strip feed line circuitry and the patch layers; and configuring the dual microstrip feed line circuitry to utilize corner-feeding techniques to enable diagonal modes of the middle metallized patch layer and the top metallized patch layer.

21. The method of claim 20, further comprising:

positioning feed lines of the dual microstrip feed line circuitry parallel to each other;

providing each feed line with a matching stub extending towards a center of the middle metallized patch layer; and spacing the matching stubs from each other.

22. The method of claim 21, further comprising:

providing each matching stub with a tip bending ninety degrees in relation to the matching stub and extending outwards from a center of the bottom dielectric substrate; and bending the matching stubs forty-five degrees in relation to the first parts of the feed lines.

23. The method of claim 20, further comprising:

providing the bow-tie shape of each of the coupling apertures of the ground plane by a middle part and two end parts, each of the coupling apertures being continuously narrowed towards the middle part with respect to the end parts.

24. The method of claim 20, further comprising:

configuring the coupling apertures in perpendicular alignment with respect to respective matching stubs.

25. The method of claim 20, further comprising:

configuring a middle part of each of the coupling apertures and respective matching stubs to be opposed.

26. The method of claim 20, wherein the bottom dielectric substrate has a thickness of 0.5-1.0 mm and a dielectric constant of 3-4; the dual microstrip feed line circuitry, the ground plane layer, the middle metallized patch layer and the top metallized patch layer each have thickness of 18-35 μm; the middle dielectric substrate has a thickness of 1-2 mm and a dielectric constant of 2-2.5; the top dielectric substrate has a thickness of 1-2 mm and a dielectric constant of 2-2.5; and the total height of the dual-polarized microstrip patch antenna structure is 12.5-19 mm.

27. The method of claim 20, wherein a surface area of the middle metallized patch layer is 1849-2209 $mm^2$, the surface area of the top metallized patch layer is 2401-2809 $mm^2$, and the surface area of the middle dielectric substrate is 3025-6400 $mm^2$.

28. A base station comprising:

a dual-polarized microstrip patch antenna structure, wherein the dual polarized microstrip patch antenna structure comprises a dual microstrip feed line circuitry underneath a bottom dielectric substrate;

a ground plane layer overlying the bottom dielectric substrate, the ground plane layer having coupling apertures etched to the ground plane layer;

a middle dielectric substrate overlying the bottom dielectric substrate and the ground plane layer;

a middle metallized patch layer stacked over the middle dielectric substrate;

a top dielectric substrate over the middle dielectric substrate and the middle metallized patch layer;

a top metallized patch layer stacked underneath the top dielectric substrate and above the middle metallized patch layer for generating two polarized beams with the middle metallized patch layer; and an air layer between the middle dielectric substrate and the top dielectric substrate separating the middle metallized patch layer and the top metallized patch layer, wherein the dual microstrip feed line circuitry is configured to utilize corner-feeding techniques to enable diagonal modes of the patch layers, and each of the coupling apertures of the ground plane layer are configured with a non-resonant bow-tie shape to enable aperture coupling between the microstrip feed line circuitry and the middle metallized patch layer and the top metallized patch layer.

29. An apparatus comprising:

assembling means for assembling a dual microstrip feed line circuitry underneath a bottom dielectric substrate;

providing means for providing a ground plane layer over the bottom dielectric substrate, the ground plane layer having coupling aperatures etched to the ground plane layer;

providing means for providing a middle dielectric substrate over the bottom dielectric substrate and the ground plane layer;

assembling means for assembling a middle patch layer over the middle dielectric substrate;

providing means for providing a top dielectric substrate over the middle dielectric substrate and the middle metallized patch layer;

assembling means for assembling a top metallized patch layer underneath the top dielectric substrate and above the middle metallized patch layer for generating two polarized beams with the middle metallized patch layer;

providing means for providing an air layer between the middle dielectric substrate and the top dielectric substrate separating the middle metallized patch layer and the top metallized patch layer;

providing means for providing each of the coupling apertures of the ground plane layer with a non-resonant bow-tie shape to enable aperture coupling between the micro-strip feed line circuitry and the patch layers; and configuring means for configuring the dual microstrip feed line circuitry to utilize corner-feeding techniques to enable diagonal modes of the middle metallized patch layer and the top metallized patch layer.

* * * * *

UNITED STATES PATENT AND TRADEMARK OFFICE

CERTIFICATE OF CORRECTION

PATENT NO. : 7,423,595 B2
APPLICATION NO. : 11/600142
DATED : September 9, 2008
INVENTOR(S) : Jussi Säily It is certified that error appears in the above-identified patent and that said Letters Patent is hereby corrected as shown below:

On the Front Page of the Patent, Item (54) and Column 1, lines 1 and 2

Please correct the title, which should read:

--DUAL-POLARIZED MICROSTRIP PATCH STRUCTURE--

Signed and Sealed this

Eleventh Day of August, 2009

David J. Kappos

David J. Kappos
*Director of the United States Patent and Trademark Office*